US008731226B2

(12) United States Patent
Gelinck et al.

(10) Patent No.: US 8,731,226 B2
(45) Date of Patent: May 20, 2014

(54) COMPOSITE MICROPHONE WITH FLEXIBLE SUBSTRATE AND CONDUCTORS

(75) Inventors: Gerwin Hermanus Gelinck, Valkenswaard (NL); Harmannus Franciscus Maria Schoo, Eersel (NL)

(73) Assignee: Nederlandse Organisatie voor toegepast-natuurwetenschappelijk onderzoek TNO, Delft (NL)

( * ) Notice: Subject to any disclaimer, the term of this patent is extended or adjusted under 35 U.S.C. 154(b) by 152 days.

(21) Appl. No.: 12/937,531

(22) PCT Filed: Apr. 24, 2009

(86) PCT No.: PCT/NL2009/050224

§ 371 (c)(1),
(2), (4) Date: Dec. 28, 2010

(87) PCT Pub. No.: WO2009/134127

PCT Pub. Date: Nov. 5, 2009

(65) Prior Publication Data

US 2011/0123058 A1 May 26, 2011

(30) Foreign Application Priority Data

Apr. 28, 2008 (EP) ..... 08075320

(51) Int. Cl.
*H04R 11/04* (2006.01)

(52) U.S. Cl.
USPC ..... 381/369

(58) Field of Classification Search
USPC ..... 381/369
See application file for complete search history.

(56) References Cited

U.S. PATENT DOCUMENTS

| | | | | |
|---|---|---|---|---|
| 5,044,053 | A | 9/1991 | Kopel et al. | |
| 5,764,778 | A | 6/1998 | Zurek | |
| 2004/0054289 | A1 | 3/2004 | Eberle et al. | |
| 2005/0123149 | A1 | 6/2005 | Elko et al. | |
| 2005/0205919 | A1 * | 9/2005 | Ozaki et al. | 257/306 |
| 2007/0115572 | A1 | 5/2007 | Van Dam et al. | |

(Continued)

FOREIGN PATENT DOCUMENTS

| | | | |
|---|---|---|---|
| EP | 0671221 | A2 | 9/1995 |
| EP | 0973149 | A2 | 1/2000 |

(Continued)

OTHER PUBLICATIONS flexible. (n.d.). Roget's 21st Century Thesaurus, Third Edition. Retrieved Jan. 24, 2013, from Thesaurus.com website: http://thesaurus.com/browse/flexible.*

(Continued)

*Primary Examiner* — Brian Ensey
*Assistant Examiner* — Katherine Faley
(74) *Attorney, Agent, or Firm* — Knobbe, Martens, Olson & Bear, LLP

(57) ABSTRACT

A composite microphone comprises a flexible and stretchable substrate (22, 122, 250, 350, 450) with a grid of flexible and stretchable first and second conductors (31*a*, . . . , 31*e*, 131*a*, 131*g*; 33*a*, . . . , 33*h*, 133*a*, 133*g*). The first conductors (31*a*, . . . , 31*e*, 131*a*, 131*g*) are arranged transverse to the second conductors (33*a*, . . . , 33*h*, 133*a*, 133*g*). A plurality of acoustic sensors (40, 140) is each in connection with a respective pair of conductors in the grid.

23 Claims, 6 Drawing Sheets

(56) References Cited

U.S. PATENT DOCUMENTS

| | | | | |
|---|---|---|---|---|
| 2007/0182695 | A1* | 8/2007 | Shimizu | 345/101 |
| 2007/0291204 | A1* | 12/2007 | Otake | 349/114 |
| 2008/0247565 | A1* | 10/2008 | Elko et al. | 381/92 |
| 2009/0129612 | A1 | 5/2009 | Takeuchi et al. | |
| 2009/0302311 | A1* | 12/2009 | Turbiez et al. | 257/40 |

FOREIGN PATENT DOCUMENTS

| | | | |
|---|---|---|---|
| EP | 0986112 | A2 | 3/2000 |
| EP | 1403212 | A2 | 3/2004 |
| JP | 2003-102097 | A | 4/2003 |
| JP | 2004-120761 | A | 4/2004 |
| JP | 2006-186792 | A | 7/2006 |
| JP | 2006-245725 | A | 9/2006 |
| JP | 2007-005969 | A | 1/2007 |
| JP | 2007-104556 | A | 4/2007 |
| JP | 2007-104562 | A | 4/2007 |
| JP | 2007-124452 | A | 5/2007 |
| JP | 2007-210083 | A | 8/2007 |
| WO | 9639707 | A1 | 12/1996 |
| WO | WO 2006/110230 | A1 | 10/2006 |
| WO | 2006-132193 | A1 | 12/2006 |
| WO | 2007004115 | A2 | 1/2007 |

OTHER PUBLICATIONS

International Search Report dated Jun. 23, 2009, for International Application No. PCT/NL2009/050224.

Graz, Ingrid et al., Flexible ferroelectret field-effect transistor for large-area sensor skins and microphones, Applied Physics Letters, 2006, vol. 89, pp. 073501-1 to 073501-3.

"Elastic Properties and Young Modulus for some Materials", http://www.EngineeringToolBox.com/young-modulus-d_417.html, in 8 pages.—Publication date of this reference is unknown but this reference was cited in European Search Report issued on Dec. 5, 2011 for European counterpart Application No. 09 739 026.4.

Baum, "The Elastic Properties of Paper: A Review", The Institute of Paper Chemistry, Appleton, Wisconcsin, IPC Technical Paper Series, No. 145, Aug. 1984, in 22 pages.

European Search Report issued on May 12, 2011 for European Application No. 09 739 026.4.

* cited by examiner

COMPOSITE MICROPHONE WITH FLEXIBLE SUBSTRATE AND CONDUCTORS

This application is the U.S. National Phase of International Application No. PCT/NL2009/050224, filed Apr. 24, 2009, designating the U.S. and published in English as WO 2009/134127 on Nov. 5, 2009 which claims the benefit of European Patent Application No. 08075320.5 filed Apr. 28, 2008.

BACKGROUND

1. Field of the Invention

The present invention relates to a composite microphone.

The present invention further relates to a method of manufacturing a composite microphone 2. Prior Art WO2006110230 discloses a composite microphone or microphone array. A microphone array has substantial advantages over a conventional microphone. For example a microphone array enables picking up acoustic signals dependent on their direction of propagation. As such, microphone arrays are sometimes also referred to as spatial filters. Their advantage over conventional directional microphones, such as shotgun microphones, is their high flexibility due to the degrees of freedom offered by the plurality of microphones and the processing of the associated beamformer. The directional pattern of a microphone array can be varied over a wide range. This enables, for example, steering the look direction, adapting the pattern according to the actual acoustic situation, and/or zooming in to or out from an acoustic source. All this can be done by controlling the beamformer, which is typically implemented in software, such that no mechanical alteration of the microphone array is needed.

SUMMARY OF THE INVENTION

It is an object of the invention to provide a composite microphone that can be manufactured cost effective.

It is a further object to provide a microphone assembly that can be manufactured cost effective.

It is a further object of the invention to provide an efficient method of manufacturing a composite microphone.

It is a further object of the invention to provide an efficient method of manufacturing a microphone assembly.

According to a first aspect of the invention a composite microphone is provided comprising a flexible and stretchable substrate with a grid of stretchable and flexible first and second conductors, the first conductors being arranged transverse to the second conductors, and a plurality of transducers each in connection with a respective pair of conductors in the grid.

In the composite microphone according to the invention the transducers are arranged at a flexible and stretchable substrate provided with a grid of stretchable and flexible electric conductors. This substrate allows for an efficient manufacturing procedure. On the one hand the flexibility of the substrate allows for transportation along arbitrary trajectories in a manufacturing plant, while various components and layers may be applied thereon with the substrate in a planar state. This allows the composite microphone to be manufactured in a cost effective way, in particular in a roll to roll process. The transducers are separately arranged from each other at the substrate. Hence, after manufacturing, the flexibility and stretchability of the substrate and the grid of conductors allows the manufactured composite microphone to be curved into a desired 3D shape suitable for sensing audio signals in a plurality of directions.

A method of manufacturing a composite microphone according to the invention comprises the steps of

- providing a flexible and stretchable substrate and forming a sensor array thereon, comprising
- applying a grid of flexible and stretchable first and second conductors, the first conductors being arranged transverse to the second conductors,
- applying a plurality of transducers each in connection with a respective pair of conductors in the grid.

In an embodiment the substrate comprises one or more perforations. The presence of the perforations in the substrate improves the flexibility and stretchability thereof. A pattern of perforations may be applied that is adapted to the desired 3D shape of the composite microphone. For example a higher density of perforations or larger perforations may be applied at locations where a relatively strong deformation of the substrate is required.

In an embodiment the acoustic sensors are formed by a thin-film transducer comprising a (ferro)electret layer that is sandwiched between two metal electrodes. These transducers have a good linear response, and can be manufactured relatively easily in a roll to roll process. An organic material may be applied for the electret layer, such as cellular polypropylene, polytetrafluoride ethylene polyvinylidene fluoride and its co-polymers with trifluoride and tetrafluoride, cyclic olefin copolymers, and odd-numbered nylons.

The electrodes of the electret may be directly coupled to the flexible and stretchable first and second conductors. In an embodiment however the state of the ferro-electric layer is sensed by current modulation of a thin-film transistor. Therein an electrode of the transducer is electrically coupled to a gate electrode of the thin-film transistor. In this way an improved signal to noise ratio is obtained.

Various options are possible to arrange the electret forming the transducer element with respect to the thin-film transistor. For example the transistor and the transducer element may be laterally arranged with respect to each other on the substrate.

Preferably however, the transducer element is arranged upon the thin-film transistor. In other words the thin-film transistor is arranged between the substrate and the transducer element. In this way a larger surface is available for sensing the sound waves which improves sensitivity. This also applies if the grid with transducers is used for a different purpose, e.g. for pressure sensing.

The thin film transistor may have a bottom-gate device geometry. In this geometry the thin film transistor comprises the following layers,

- a gate electrode applied at the substrate,
- a first insulator layer on the gate electrode,
- a source and a drain region arranged separately from each other on the first insulator layer,
- a semiconductor layer upon the first insulator layer and the source and the drain region,
- a second insulator layer upon the semiconductor layer.

Upon this bottom-gate thin-film transistor the ferro-electret is arranged with a bottom electrode upon the second insulator layer. An electric connection is applied between the gate electrode and the bottom electrode through the first insulating layer, the semiconductor layer and the second insulator layer of the thin-film transistor. The ferro-electret further comprises a layer of a ferro electric material at the bottom electrode and a top electrode at the layer of ferro electric material. In this embodiment, with the thin-film transistor in bottom-gate device geometry the second insulator provides for a good protection against parasitic capacitive effects.

Another embodiment is possible wherein the thin-film transistor has a top-gate device geometry. In this case a source and a drain region are arranged separate from each other at the substrate and a semiconductor layer is applied at the substrate and the source and the drain region. An insulator layer is applied at the semiconductor layer and a gate electrode is applied at the insulator layer. A ferro-electric layer may be applied directly between the gate electrode, and a top electrode. Therein the gate electrode functions additionally as a bottom electrode of the electret. This embodiment is advantageous, in that it has a very simple construction. However, the electrode functioning both as a gate electrode of the thin-film transistor and a bottom electrode of the electret may form a relatively large parasitic capacitance with the source and the drain of the transistor, which may be undesired for some applications. In a variant of this embodiment the ferro-electret has a separate bottom electrode and a further insulator layer is arranged between the gate electrode of the thin-film transistor and the bottom electrode of the electret, while the gate electrode and the bottom electrode are coupled by an electric connection through the further insulator. This has the advantage that a good suppression of parasitic effects is obtained, while it is not necessary that a conductor is present through the semiconductor layer.

The microphone may further comprise read-out circuitry on the substrate for the active-matrix array that is coupled to the first and the second conductors. By arranging this circuitry on the same substrate, a relatively low number of external signal lines to be coupled to the microphone suffices. The read-out circuitry for example comprising row and column shift registers, may be made with the same semiconductor process geometry as used for the matrix transistors.

Organic materials may be used for the components used for the transducers in the composite microphone, including the semiconductor layer the dielectrics, the (ferro) electret layer and the electrodes.

A microphone assembly according to the invention comprises one or more composite microphones according to one of the previous claims, with the substrate stretched over a convex carrier body. By stretching the substrate over the convex carrier body, each acoustic sensors in the array is oriented according to the normal of the surface of said convex carrier body at the position where it is arranged after stretching so that a wide-angle sensitivity is obtained. A good fit of the substrate against the carrier body is obtained until a spatial angle of $2\pi$ sr. An omni-directional sensitivity is obtained by combining two or more of these convex carrier bodies provided with a micro-phone assembly in this way.

A compact embodiment of a microphone assembly having omnidirectional sensitivity comprises a spheric body, composed of a pair of hemi-spheres, that face each other at a first side and that are each provided with a flexible substrate according to the invention. The substrate portions can be applied with a relatively low amount of distortion at their respective hemi-sphere. This embodiment allows for an efficient manufacturing, as the spheric body can be covered with the flexible substrate in only two steps, and as the substrate portions can be applied relatively simple at their respective hemi-sphere. The body may contain electronic circuitry for processing output signals obtained from the transducers.

BRIEF DESCRIPTION OF THE DRAWINGS

These and other aspects are described in more detail with reference to the drawing. Therein.

DETAILED DESCRIPTION OF EMBODIMENTS

Figure 4:
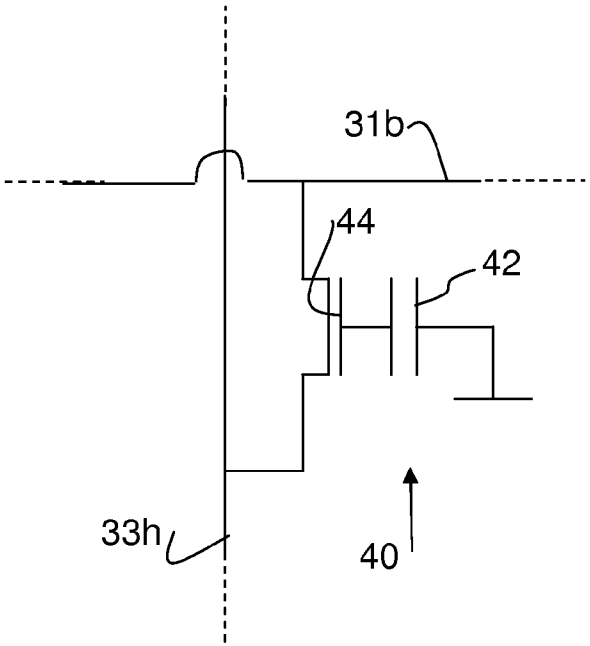
FIG. 4 shows a part of a composite microphone.

In the following detailed description numerous specific details are set forth in order to provide a thorough understanding of the present invention. However, it will be understood by one skilled in the art that the present invention may be practiced without these specific details. In other instances, well known methods, procedures, and components have not been described in detail so as not to obscure aspects of the present invention. The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

In the drawings, the size and relative sizes of layers and regions may be exaggerated for clarity. Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of the invention.

It will be understood that when a layer is referred to as being "on" a layer, it can be directly on the other layer or intervening layers may be present. In contrast, when an element is referred to as being "directly on," another layer, there are no intervening layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1:
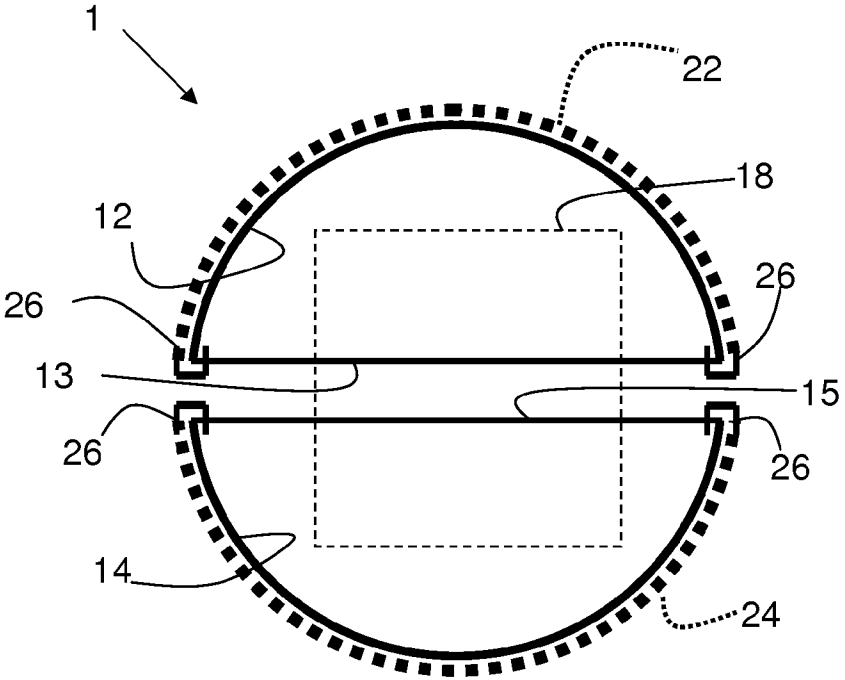
FIG. 1 shows a microphone assembly.

FIG. 1 shows a micro-phone assembly comprising a spheric body, composed of a pair of convex carrier bodies in the form of hemi-spheres 12, 14, that face each other at a first side 13, 15, and that are each provided with a composite microphone formed on a substrate 22, 24. The substrate 22, 24 is a layer of a flexible and stretchable material, e.g. a PET (Poly Ethylene Terephthalate) or a PEN (Poly Ethylene Naphthalate) layer.

The flexible and stretchable substrates 22, 24 are stretched over their respective hemi-sphere 12, 14, and mounted with hooks with hooks 26 thereon. Alternatively the substrates 22, 24 may be adhered to the hemi-spheres 12, 14 with an adhesive. The pair of hemi-spheres 12, 14 enclose a signal processing unit 18 for processing signals from the composite microphone.

Figure 2:
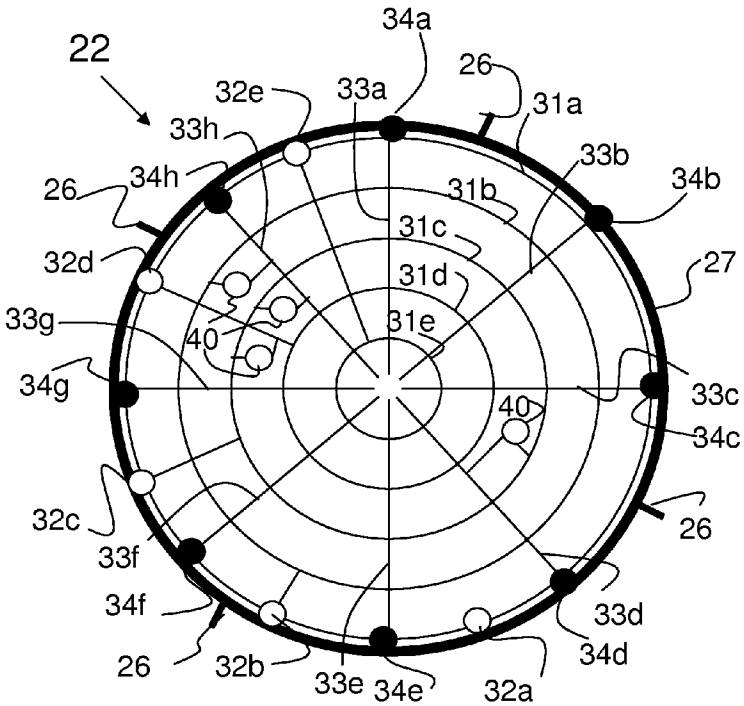
FIG. 2 shows a first embodiment of a composite microphone according to the invention.

FIG. 2 shows one of the composite microphones in more detail. The other composite microphone preferably has a similar construction. As shown in FIG. 2, the substrate 22 is provided with a grid formed by first conductors 31*a*, . . . , 31*e* and second conductors 33*a*, . . . , 33*h*. Although in this case the grid comprises 5 first conductors and 4 second conductors, the grid may be realized with any other combination of first and second conductors. The first conductors are arranged transverse to the second conductors. In this case the first conductors are arranged tangentially and the second conductors are arranged radially, so that they cross each other perpendicularly and that are isolated from each other. The first conductors 31*a*, . . . , 31*e* are coupled to respective contact terminals 32*a*, . . . 32*e* at a reinforment ring 27 at an outer edge of the substrate 22. The most outward first conductor 31*a* is directly connected to its contact terminal 32*a*. The other first conductors 31*b*, . . . 31*e* are connected to their contact terminals 32*b*, . . . , 32*e* via auxiliary radial conductors. The second conductors 33*a*, . . . , 33*h* are coupled to further contact terminals 34*a*, . . . 34*h* at the reinforcement ring 27. A plurality of transducers 40 is applied at the substrate. Each is connected with a respective pair of a first conductor and a second conductor in the grid. For clarity only four transducers 40 are shown in the drawing. However, in practice the array may comprise a transducer corresponding to any pair of a first and a second conductor. Accordingly this amounts to a total of 40 transducers.

The first and second conductors, as well as the auxiliary conductors are flexible and stretchable. Flexible and stretchable conductors may be realized for example by providing them in a meandering shape, as described for example in US2007115572. Alternatively materials may be used that are inherently flexible, stretchable and conductive, e.g. a blend of a conductive and a non-conductive polymer as described for example in WO9639707. Preferably the circumference of the substrate 22 initially has value of at most the value of the circumference of the hemi-sphere 12 at which it is to be arranged. In this way the substrate 22 closely matches the outer surface of the hemi-sphere, so that has a well-defined shape. Preferably the circumference of the substrate 22 initially has a value of at least two third (⅔) of the value of the circumference of the hemi-sphere 12 at which it is to be arranged. At a substantially smaller initial circumference of the substrate 22, e.g. a less than half the circumference of the hemi-sphere, relatively strong forces are necessary to mount the substrate 22 at the hemi-sphere, which complicate manufacturing and could damage the substrate.

In the particular case that the initial circumference of the substrate 22 is the same as the outer circumference of the hemi-sphere 12 the deformation Sr in the radial direction is $\pi/2$, i.e. the substrate is stretched approximately by a factor 1.5. The deformation in the tangential direction varies between $\pi/2$ in the centre of the substrate 22 to 0 at the edge of the substrate.

Figure 3:
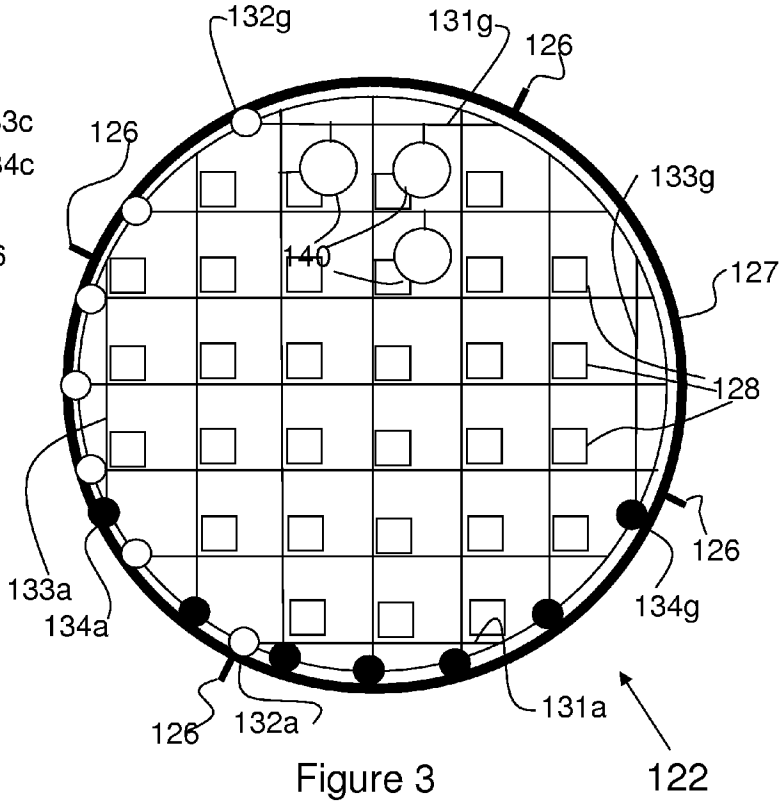
FIG. 3 shows a second embodiment of a composite microphone according to the invention.

It is not necessary that the first and the second conductors are arranged according to a polar grid. FIG. 3 shows an alternative arrangement, wherein the first and the second conductors are arranged according to a Cartesian grid. Parts therein corresponding to those in FIG. 2 have a reference number that is 100 higher. For clarity only two of the first conductors are indicated by a reference numeral, 131*a* and 131*g* respectively. Likewise only two of the second conductors 133*a*, 133*g* are indicated by a reference numeral. As can be seen in FIG. 4, it is an advantage of this arrangement that each of the first and the second conductors can be connected directly to a respective contact terminal, e.g. 132*a*, 132*g*, 134*a*, 134*g*. In the embodiment of FIG. 3 the substrate 122 comprises one or more perforations 128. The perforations 128 facilitate a deformation of the substrate 122. The position and size of the perforations may be selected to determine the amount of deformation. The size of the perforations 128 may vary as a function of the position on the substrate 122 to control the amount of deformation of the substrate 122 as a function of the position.

FIG. 4 schematically shows a circuit diagram of a transducer 40 suitable for use in a microphone according to the present invention. By way of example the transducer 40 is shown coupled to the first conductor 31*b* and second conductor 33*h* in the embodiment of the composite microphone according to FIG. 2. In practice the same transducers may be used for in the entire array. These transducers may also be used as the transducers 140 in the Cartesian array of FIG. 3. The transducer 40 shown in FIG. 4 comprises a FET 44 having a main current path between the first conductor 31*b* and second conductor 33*h*. The conductivity of the FET 44 is controlled by the pressure sensitive electret 42 connected at one side to its gate. The electret 42 is coupled to a reference voltage supply at its other side. Such a ferro-electret comprising a (ferro)electret layer that is sandwiched between two electrodes forms a thin-film transducer. The electret layer may be formed by an organic material, e.g. polypropylene or another polymer. If needed, these materials can be internally charged by a corona discharge in air. Optionally, the conductivity of FET 44 is modulated by applying an external voltage to its gate (this requires additional conductors (not shown in Figures).

In the embodiments shown in FIGS. 2 and 3, the first conductors 31*a*, . . . , 31*e*; 131*a*, 131*g* and second conductors 33*a*, . . . , 33*h*; 133*a*, 133*g*, are connected to contact terminals 32*a*, . . . 32*e*, 34*a*, . . . , 34*e*; 132*a*, 132*g*; 134*a*, 134*g* at an outer edge of the substrate 22, 122. In an alternative embodiment the substrate may further comprise read-out circuitry for the active-matrix array formed by the acoustic sensors arranged in the grid. Such read-out circuitry may comprise row and column shift registers. Preferably the same semiconductor process and device geometry is used therefore as used for the matrix transistors 44.

Figure 5A:
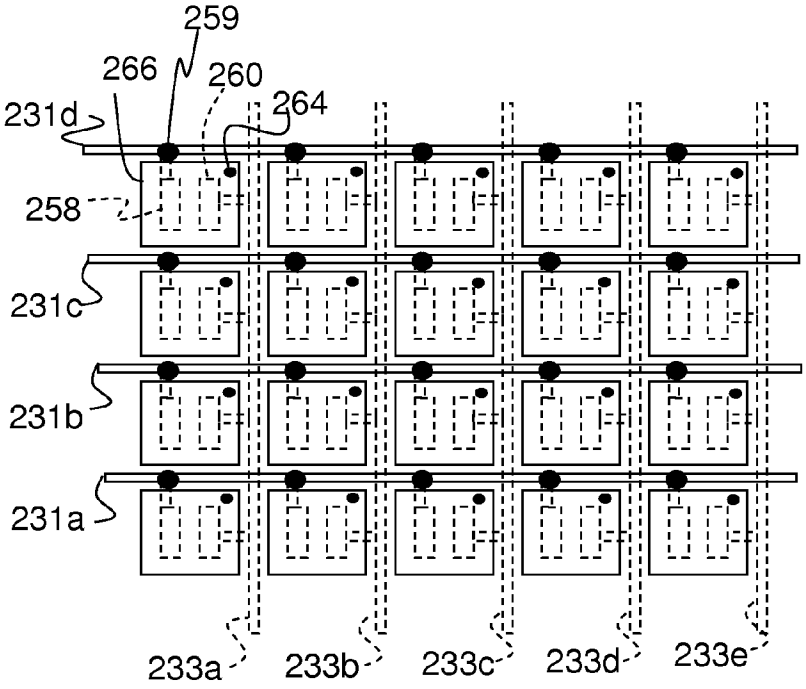
FIG. 5A shows a cross-section according to A-A in FIG. 5.
Figure 5:
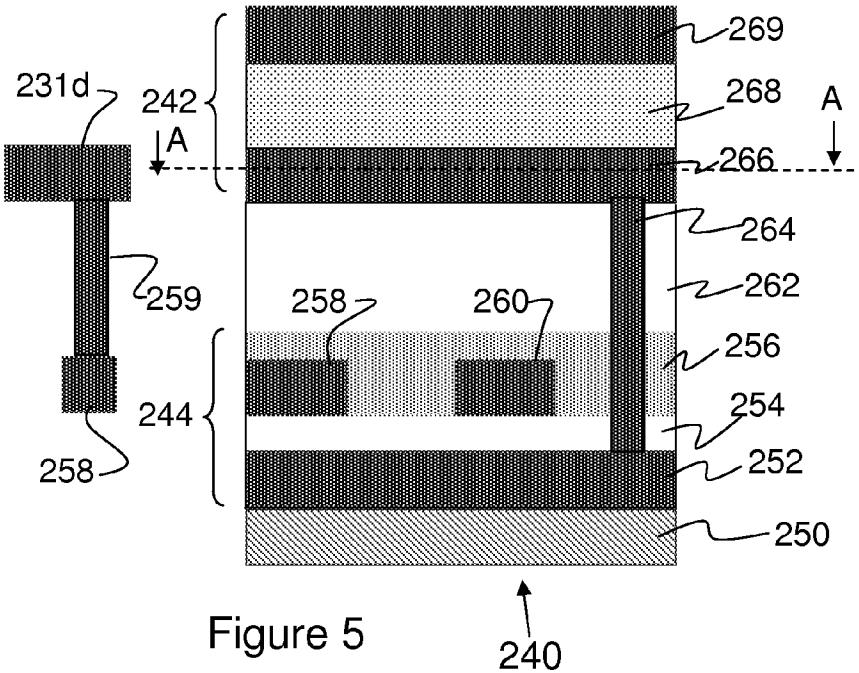
FIG. 5 shows a first implementation of the part shown in FIG. 4.

FIG. 5 shows a first preferred implementation of the transducer 240. Parts therein corresponding to those in FIG. 4 have a reference number that is 200 higher. In the implementation of FIG. 5, the FET 244 has a bottom-gate device geometry. In this geometry the thin film transistor 244 comprises a gate electrode 252 on the substrate 250. A first insulator layer 254 is applied on the gate electrode 252. A source and a drain region 258, 260 are arranged separately from each other on the first insulator layer 254, and a semiconductor layer 256 is arranged upon the first insulator layer 254 and the source and the drain region 258, 260. A second insulator layer 262 is deposited upon the semiconductor layer 254. Upon this bottom-gate thin-film transistor 244 the ferro-electret 242 is arranged with a bottom electrode 266 upon the second insulator layer 262. An electric connection 264 is applied between the gate electrode 252 and the bottom electrode 266 through the first insulator layer 254, the semiconductor layer 256 of the thin-film transistor 244 and the second insulator layer 262 between the thin-film transistor 244 and the ferro-electret 242. The ferro-electret 242 further comprises a layer 268 of a ferro electric material at the bottom electrode 266 and a top electrode 269. In this embodiment, with the thin-film transistor 244 in bottom-gate device geometry the second insulator 262 provides for a good protection against parasitic capacitive effects. The source 258 is coupled to a respective first conductor 231*a* in the plane of the bottom electrode layer 266, by a via 259 through the semiconductor layer 256 and the isolator layer 262. The drain 260 is coupled a respective second conductor 233*a* in the same plane as the layer of the drain 260. This is illustrated also in FIG. 5A, which shows a cross-section A-A through the plane of the bottom electrode layer 266. FIG. 5A further shows in dashed mode the plane through the drain 258 and the source 260.

It is not necessary that the transducer 240 of this embodiment only comprises these layers. It is sufficient that the layers are present in the order presented in FIG. 5. For example, the gate electrode 252 may be applied directly on the substrate 250, but alternatively one or more layers may be present between the substrate 250 and the gate electrode 252.

Figure 6:
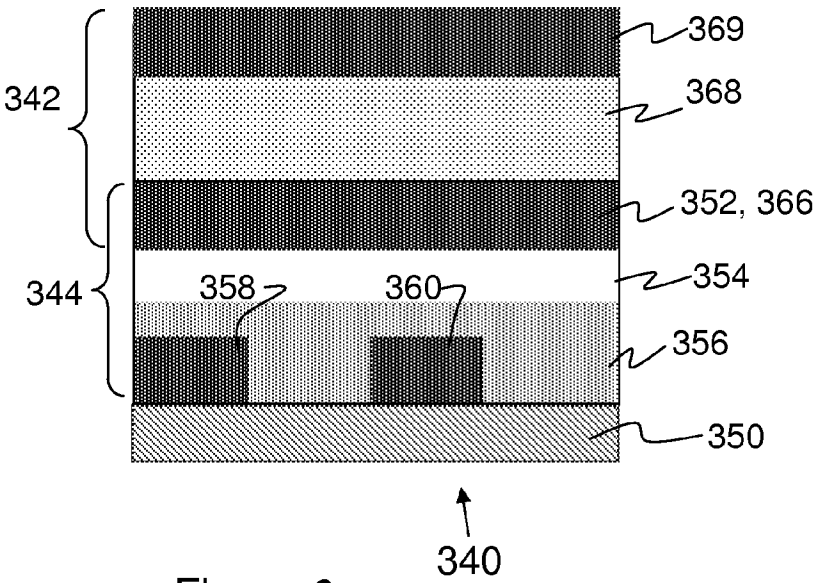
FIG. 6 shows a second implementation of the part shown in FIG. 4.

FIG. 6 shows a second preferred implementation of the transducer 340. Parts therein corresponding to those in FIG. 5 have a reference number that is 100 higher. In the implementation of FIG. 6, the FET 344 has a top-gate device geometry. In this case a source and a drain region 358, 360 are arranged separate from each other at the substrate 350 and a semiconductor layer 356 is applied at the substrate 350 and the source and the drain region 358, 360. An insulator layer 354 is applied at the semiconductor layer 356 and a gate electrode 352 is applied at the insulator layer 362. In the embodiment shown a ferro-electric layer 368 is be applied directly between the gate electrode 352, and a top electrode 369. Therein the gate electrode 352 functions additionally as a bottom electrode 366 of the electret 342. This embodiment is advantageous, in that it has a very simple construction.

Figure 7:
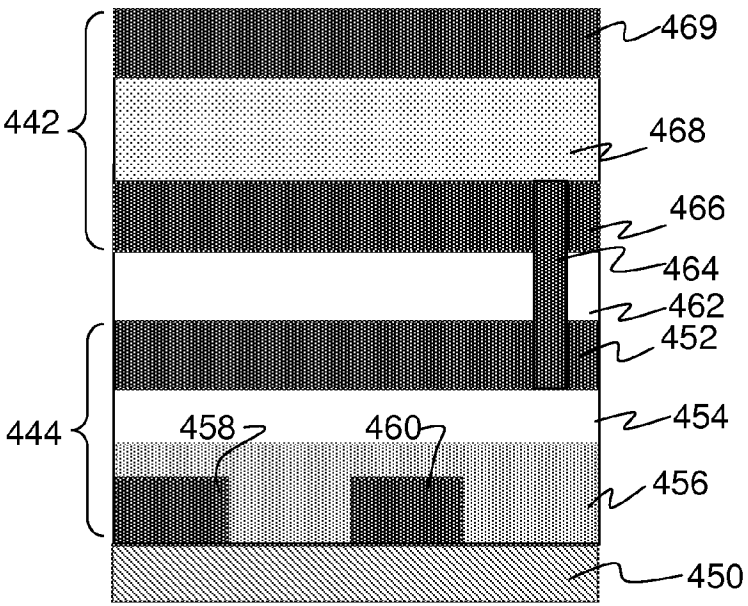
FIG. 7 shows a third implementation of the part shown in FIG. 4.

A variant of this embodiment is shown in FIG. 7. Therein parts corresponding to those in FIG. 5 have a reference number that is 200 higher. In the variant shown in FIG. 7, the ferro-electret 442 has a separate bottom electrode 466 and a further insulator layer 462 is arranged between the gate electrode 452 of the thin-film transistor 444 and the bottom electrode 466 of the electret 442. The gate electrode 452 and the bottom electrode 466 are coupled by an electric connection 462 through the further insulator layer 462. This has the advantage that a good suppression of parasitic effects is obtained, while it is not necessary that a conductor is present through the semiconductor layer.

The transistor and the ferro-electret may alternatively be laterally arranged with respect to each other on the substrate. This amounts to the lowest number of layers that need patterning. However, the embodiments described with reference to FIGS. 5, 6 and 7, wherein the ferro-electret is stacked upon the thin film transistor have the advantage that a larger surface is available for sensing by the ferro-electret, which is advantageous for the sensitivity of the microphone. In principle it is possible to arrange the stack the other way around, i.e. with the ferro-electret between the substrate and the thin-film transistor, but this would negatively influence the sensitivity of the microphone, as the surface of the ferro-electret is hidden by the thin-film transistor.

As the semiconductor material in the thin-film transistors 42, 242, 342, 442 an inorganic material, such as α-Si may be applied. Alternatively an organic material, e.g. pentacene may be used therefore. The electrodes of the thin-film transistors and the transducers may be formed by a metal, such as Au, Ag, Pt, Pd or Cu. Furthermore, conductive polymer such as polyaniline and polythiophene derivatives may be used instead. Isolating layers may be formed by an inorganic material such as an aluminium oxide or silicon dioxide, but alternatively a non-conducting polymer may be used such as polyvinylphenol, polystyrene. Although the substrate and its grid of conductors themselves are already stretchable and flexible and the acoustic sensor elements are separately arranged from each other at the substrate, the use of organic materials for the components of the acoustic sensors in the array further improves the stretchability and flexibility of the composite microphone.

It is noted that in practical embodiments the substrate has a thickness larger than the stack of layers forming the transducer. For example the substrate has a thickness in the order of 10 to 200 μm, depending on the requirements on strength and flexibility. However, for clarity the substrate is presented in Figures as a relatively thin layer. Generally the other layers have a thickness in the range of 30 nm to 1 μm. The conductive layers may depending on the required conductivity for example have a thickness in a range of 30 nm to 1 μm, e.g. 100 nm. The isolator layers may be in a range of 50 to 300 nm. An isolating layer separating the electret from the thin-film transistor may however be much thicker, e.g. layer 262 or 462 may have a thickness of 1 to 10 μm. The electret layer may have a thickness in the range of 10 to 200 μm, e.g. 70 μm.

Figure 8A:
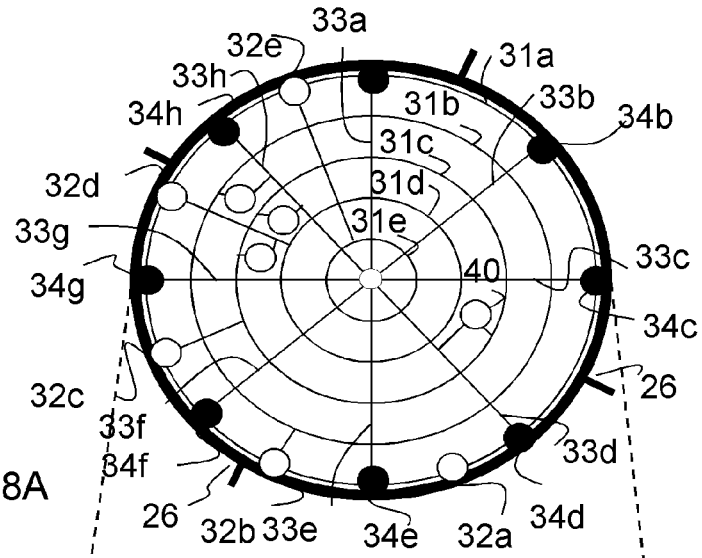
FIG. 8A shows the composite microphone of FIG. 2 in the original state.
Figure 8B:
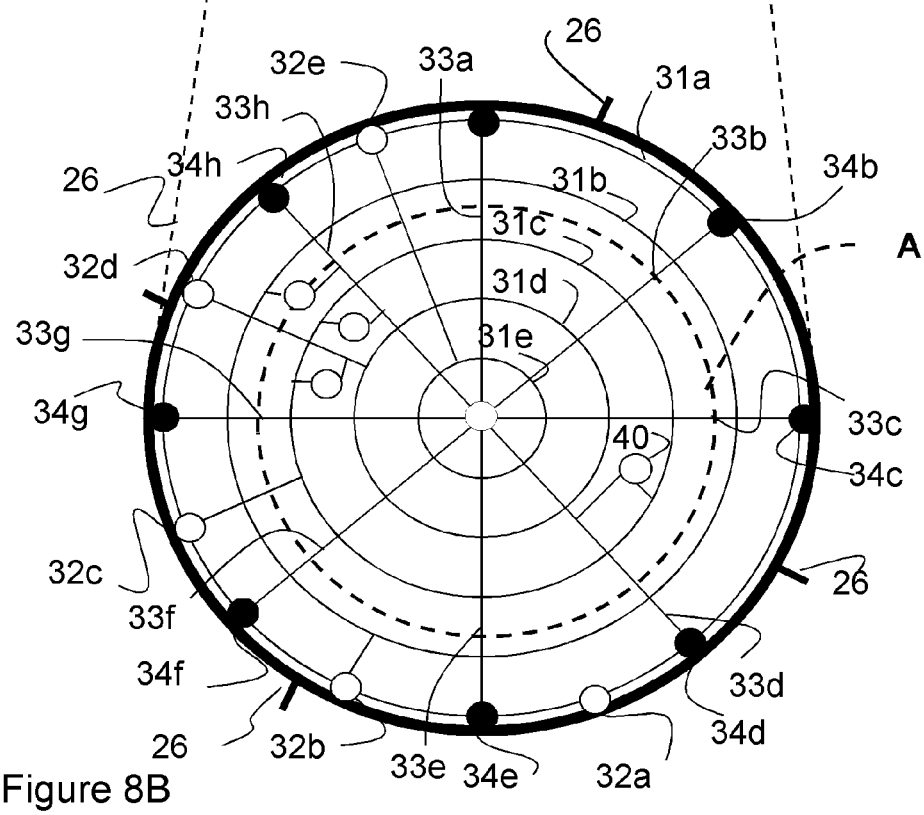
FIG. 8B shows that composite microphone of FIG. 2 after it is uniformly stretched by a factor 1.5.
Figure 9A:
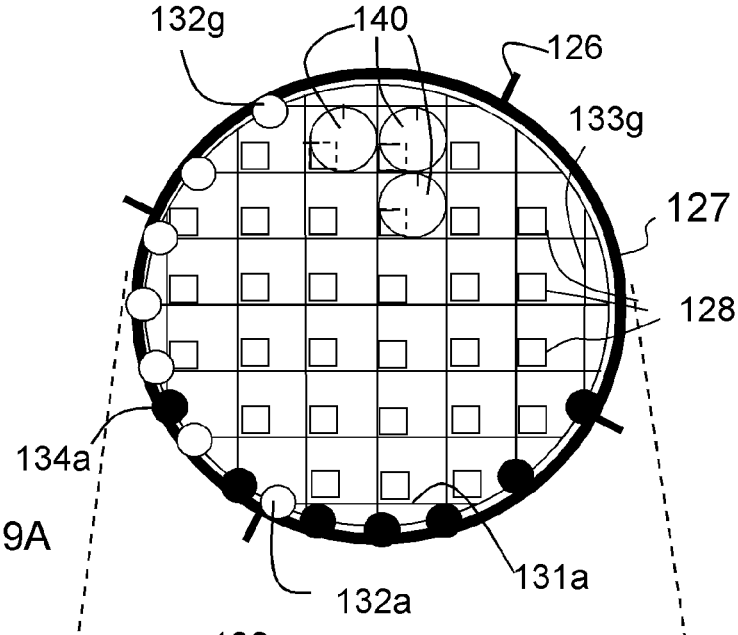
FIG. 9A shows the composite microphone of FIG. 3 in the original state.
Figure 9B:
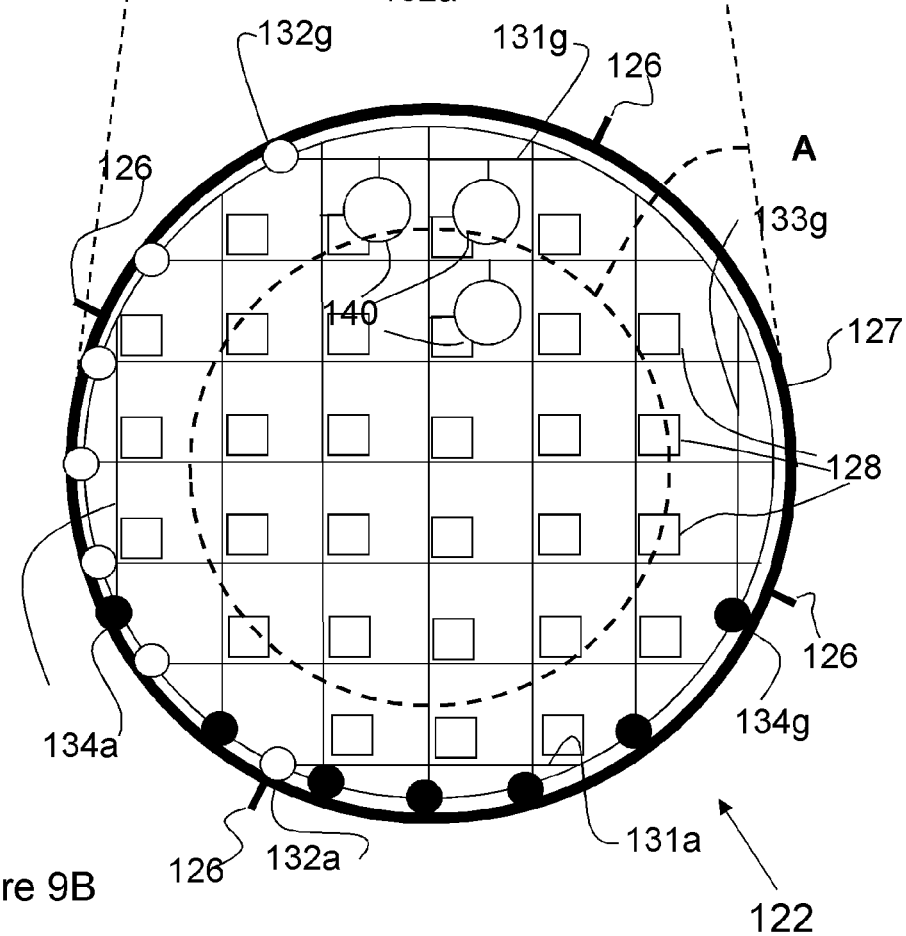
FIG. 9B shows that composite microphone after it is uniformly stretched by a factor 1.5.

FIG. 8A shows the composite microphone of FIG. 2 in the original state and FIG. 8B shows the composite microphone of FIG. 2 after it is uniformly stretched by a factor 1.5. In a similar manner, FIG. 9A shows the composite microphone of FIG. 3 in the original state and FIG. 9B shows that composite microphone after it is uniformly stretched by a factor 1.5.

A method of manufacturing a composite microphone as described with reference to the FIGS. 1-7 may comprise the steps of providing a flexible substrate and forming a sensor array thereon, comprising applying a grid of stretchable and flexible first and second conductors, the first conductors being arranged transverse to the second conductors, applying a plurality of acoustic sensors in connection with a respective pair of conductors in the grid.

The various components of the microphone may be applied at the substrate in a way known as such. For example electrodes of the thin-film transistors or the electrets may be applied by first applying a conductive layer, such as a metal, or a conductive polymer over the entire surface of the composite microphone in production. Subsequently the layer may be patterned by etching techniques or by imprinting. Alternatively the electrodes may be formed by a patterned printing technique. Likewise other functional elements of the microphone, such as first and second conductors, the semiconductor layers, the insulator layers and the drain and source regions as well as the electret layer may be formed.

"Vertical" conductors, i.e. conductors extending in a direction transverse to the plane of the substrate, from a higher layer to a lower layer can be formed by techniques as described in EP0986112 and WO2007004115.

In the claims the word "comprising" does not exclude other elements or steps, and the indefinite article "a" or "an" does not exclude a plurality. A single component or other unit may fulfill the functions of several items recited in the claims. The mere fact that certain measures are recited in mutually different claims does not indicate that a combination of these measures cannot be used to advantage. Any reference signs in the claims should not be construed as limiting the scope.

What is claimed is:

1. A composite microphone comprising:

a flexible and stretchable substrate with a grid of flexible and stretchable first and second conductors, the first conductors being arranged transverse to the second conductors, and a plurality of acoustic sensors each in connection with a respective pair of conductors in the grid, wherein the substrate and the first and second conductors are stretched at least 1.5 times in at least one direction to form a curved structure without impairing functionality of the microphone, said curved structure having center and an edge and having a deformation at the center in both a radial direction and a tangential direction of at least $\pi/2$, with the deformation in the tangential direction decreasing from the center towards the edge.

2. The composite microphone according to claim 1, wherein the flexible and stretchable substrate comprises one or more perforations.

3. The composite microphone according to claim 1, wherein the plurality of acoustic sensors comprise a thin-film transducer comprising a (ferro)electret layer that is sandwiched between two electrodes.

4. The composite microphone according to claim 3, wherein the (ferro) electret layer is of an organic material.

5. The composite microphone according to claim 3, wherein a state of the (ferro) electret layer is sensed by current modulation of a thin-film transistor, an electrode of the thin-film transducer being electrically coupled to a gate electrode of the thin-film transistor.

6. The composite microphone according to claim 5, the thin-film transistor and the thin-film transducer being laterally arranged with respect to each other on the flexible and stretchable substrate.

7. The composite microphone according to claim 5, wherein the thin-film transducer is arranged upon the thin-film transistor.

8. The composite microphone according to claim 7, wherein the thin-film transistor comprises a bottom-gate device geometry.

9. The composite microphone according to claim 7, wherein the thin-film transistor comprises a topgate TFT device geometry.

10. The composite microphone according to claim 5, further comprising read-out circuitry for an active-matrix array, the read-out circuitry comprising row and column shift registers made with a same semiconductor process geometry as used for respective thin-film transistors of the plurality of acoustic sensors.

11. The composite microphone according to claim 5, wherein the thin-film transistor comprises organic semiconductor and/or organic dielectrics and/or organic electrodes.

12. A microphone assembly, comprising one or more composite microphones according to claim 1, with the flexible and stretchable substrate stretched over a convex carrier body.

13. The microphone assembly, according to claim 12, comprising a first and a second convex carrier body in the form of a hemi-sphere, which hemi-spheres face each other at their widest side.

14. The microphone assembly, according to claim 13, wherein a pair of hemi-spheres enclose a signal processing unit for processing signals from the composite microphone.

15. A method of manufacturing a composite microphone comprising:

providing a flexible and stretchable substrate in an initial state and forming a sensor array thereon, comprising applying a grid of stretchable and flexible first and second conductors, the first conductors being arranged transverse to the second conductors, applying a plurality of acoustic sensors in connection with a respective pair of conductors in the grid, and stretching the flexible and stretchable substrate at least 1.5 times from the initial state of the substrate to form a curved structure without impairing functionality of the microphone, said curved structure having a center and an edge and having a deformation at the center in both a radial direction and a tangential direction of at least $\pi/2$, with the deformation in the tangential direction decreasing from the center towards the edge.

16. The method according to claim 15, wherein said applying a plurality of acoustic sensors comprises applying a thin-film transistor and applying a ferro-electret.

17. The method according to claim 16, wherein the ferro-electret is applied at the thin film transistor.

18. The method according to claim 16, wherein said applying a plurality of acoustic sensors comprises applying on the flexible and stretchable substrate a gate electrode, applying a first insulator layer on the gate electrode, applying on the first insulator layer a source and a drain region arranged separate from each other, applying a semiconductor layer on the first insulator layer and the source and the drain region, applying a second insulator layer on the semiconductor layer, applying a bottom electrode on the second insulator layer, applying an electric connection between the gate electrode and the bottom electrode through the first insulating layer, the semiconductor layer and the second insulator layer, a layer of a ferro electric material on the bottom electrode, and applying a top electrode on the layer of ferro electric material.

19. The method according to claim 16, wherein said applying a plurality of acoustic sensors comprises applying on the flexible and stretchable substrate a source and a drain region arranged separate from each other, applying a semiconductor layer on the flexible and stretchable substrate and the source and the drain region, applying an insulator layer on the semiconductor layer, applying a gate electrode on the insulator layer, applying a ferro electric layer on the gate electrode, and applying a top electrode on the ferro electric layer.

20. The method of claim 15, further comprising providing a circular shaped composite microphone and stretching the flexible and stretchable substrate to fit to the surface of a convex body.

21. The method according to claim 20, further comprising connecting the first and second conductors to external first and second conductors.

22. The method according to claim 21, comprising merging a pair of hemi-spheric bodies provided with a composite microphone into a sphere shaped body.

23. The method according to claim 22, wherein a hollow portion of the sphere shaped body comprises signal processing circuitry coupled to said external first and second conductors.

* * * * *